US008610303B2

(12) United States Patent
Yocum, Jr.

(10) Patent No.: US 8,610,303 B2
(45) Date of Patent: Dec. 17, 2013

(54) SYSTEM AND METHOD FOR DOWNHOLE GEOTHERMAL ELECTRICAL POWER GENERATION

(76) Inventor: John R. Yocum, Jr., Broken Arrow, OK (US)

( * ) Notice: Subject to any disclaimer, the term of this patent is extended or adjusted under 35 U.S.C. 154(b) by 72 days.

(21) Appl. No.: 13/343,516

(22) Filed: Jan. 4, 2012

(65) Prior Publication Data

US 2013/0168965 A1 Jul. 4, 2013

(51) Int. Cl.
*F03B 13/00* (2006.01)

(52) U.S. Cl.
USPC ..... 290/54; 290/43; 60/641.1

(58) Field of Classification Search
USPC ..... 290/43, 54; 165/45; 60/641.1, 641.2
See application file for complete search history.

(56) References Cited

U.S. PATENT DOCUMENTS

| | | | | |
|---|---|---|---|---|
| 3,470,943 | A | 10/1969 | Van Huisen | |
| 3,786,858 | A | 1/1974 | Potter et al. | |
| 3,817,038 | A | 6/1974 | Pauli et al. | |
| 3,957,108 | A | 5/1976 | Van Hulsen | |
| 4,044,830 | A | 8/1977 | Van Hulsen | |
| 4,051,677 | A | 10/1977 | Van Hulsen | |
| 4,054,176 | A | 10/1977 | Van Hulsen | |
| 4,094,356 | A | 6/1978 | Ash et al. | |
| 4,201,060 | A * | 5/1980 | Outmans | 60/641.2 |
| 4,290,266 | A | 9/1981 | Twite et al. | |
| 4,297,847 | A | 11/1981 | Clayton | |
| 4,458,492 | A | 7/1984 | Ziegenhain | |
| 4,644,750 | A | 2/1987 | Lockett et al. | |
| 5,058,386 | A | 10/1991 | Senanayake | |
| 5,095,705 | A | 3/1992 | Daly | |
| 5,685,362 | A | 11/1997 | Brown | |
| 5,839,508 | A | 11/1998 | Tubel et al. | |
| 6,073,448 | A | 6/2000 | Lozada | |
| 6,259,165 | B1 | 7/2001 | Brewington | |
| 6,301,894 | B1 | 10/2001 | Halff | |
| 7,017,650 | B2 | 3/2006 | Johnson et al. | |
| 7,251,938 | B1 | 8/2007 | Bond | |
| 7,849,690 | B1 | 12/2010 | Lakic | |
| 7,975,482 | B2 | 7/2011 | Foppe | |
| 8,294,290 | B2 * | 10/2012 | da Silva | 290/52 |
| 2005/0224474 | A1 * | 10/2005 | Kilburn | 219/121.68 |

(Continued)

FOREIGN PATENT DOCUMENTS

| | | |
|---|---|---|
| RU | 1827396 A1 | 7/1993 |

OTHER PUBLICATIONS

PCT/US2013/020016, Filed Jan. 3, 2013; John R. Yocum, International Search Report and Written Opinion.

(Continued)

*Primary Examiner* — Vanessa Girardi
(74) *Attorney, Agent, or Firm* — Fellers, Snider, Blankenship, Bailey & Tippens, P.C.; Terry L. Watt

(57) ABSTRACT

There is provided herein a system and method for generating downhole electricity from wells or similar apertures that penetrate sufficiently deep into the subsurface to allow liquid water to be converted to steam. In the preferred embodiment, a well that reaches to a point in the subsurface where the ambient temperature at depth is significantly above the boiling point of water (i.e., greater than 212° F.) will be used, said steam providing the force necessary to turn the blades of a turbine which, in turn, provides rotational force a downhole generator, thereby resulting in the generation of electricity.

15 Claims, 3 Drawing Sheets

(56) References Cited

U.S. PATENT DOCUMENTS

| | | | | |
|---|---|---|---|---|
| 2006/0130480 | A1 | 6/2006 | Lovelace | |
| 2007/0245729 | A1 | 10/2007 | Mickleson | |
| 2009/0126923 | A1 | 5/2009 | Montgomery et al. | |
| 2009/0211757 | A1 | 8/2009 | Riley | |
| 2011/0067399 | A1 | 3/2011 | Rogers et al. | |
| 2011/0273147 | A1* | 11/2011 | Hall et al. | 322/28 |
| 2013/0062881 | A1* | 3/2013 | Mellah | 290/50 |

OTHER PUBLICATIONS

"Artificial Lift Electrical Submersible Pumping Systems" 2010 Printout from Baker Hughes.
Espump.com, Sep. 17, 2012 printout from website.
Halliburton Product Announcement for "Turbopower Turbine Drilling Technology", Nov. 1, 2011.
Submersible Pump definition from Widipedia, Oct. 2, 2012.

* cited by examiner

SYSTEM AND METHOD FOR DOWNHOLE GEOTHERMAL ELECTRICAL POWER GENERATION

FIELD OF THE INVENTION

The present invention relates generally to the field of power generation and, more particularly, power generation via geothermal energy.

BACKGROUND OF THE INVENTION

Geothermal energy has been used in one form or another for many thousands of years to make life better. Beginning with early hot springs that were valued for their curative or restorative properties and continuing today with geothermal electrical generation at geothermal hotspots, this energy source has been valued for its renewability and low environmental impact.

Turning specifically now to generation of electrical power by geothermal means, possibly the most common approach is to utilize hot water and/or steam that originates beneath the surface of the earth into a heat exchanger or a turbines, etc. with the goal of generating electric power. Typically, these sorts of power plants are large-scale operations that are situated near geothermal hot spots. Obviously, such large-scale facilities are best situated near a correspondingly large near-surface heat source, of which there are not that many candidates. For example, Yellowstone National Park would be a tremendous source of geothermal energy but is off limits to commercial development for obvious reasons.

This fact (i.e., the relative rarity of near-surface geothermal heat sources) has made utilization of this source of energy for power generation problematic. Of course, the general scarcity of geothermal hot spots near population centers has made it correspondingly more difficult to attract the funds that would be necessary to build a generating plant at a remote location and transmit the power to the consumers that need it.

That being said, those of ordinary skill in the art will recognize that it is possible to find extremely high subsurface temperatures almost anywhere if a sufficiently deep penetration into the subsurface available. Of particular interest for purposes of the instant application are wells that might have been drilled to depth specifically for purposes discussed hereinafter or, possibly, hydrocarbon (e.g., oil and/or gas) wells that might either be wells that have exhausted their oil source or wells that failed to uncover any petroleum deposits at all depths (e.g., dry holes). These sorts of abandoned or otherwise available well shafts provide access to the deep subsurface where temperatures at the bottom might be well above the boiling point of water at atmospheric pressure (e.g., 212° F. or 100° C.). In fact, and depending on the local geothermal gradient, a well of depth 10,000-20,000 feet is likely to encounter temperatures more than sufficient to boil water and, in many cases, temperatures high enough to superheat water.

However, one problem with utilizing the thermal energy that might be available at the bottom of such wells is that existing approaches are not well suited to exploiting geothermal energy on such a small scale. That is, in order to be economic conventional geothermal power plants require a substantial heat source that can continuously produce a high quantity of steam for a long period of time. But, preexisting deeply penetrating wells are typically not drilled close enough together to likely be of much use in this context. Further, even if there are multiple wells located in close proximity the economics of collecting, collating, and transporting the steam from the wells to the generator will make the project uneconomic. On the other hand, there are large numbers of individual abandoned wells that, if the technology existed, could be relied upon to produce steam or superheated steam on a small scale.

Thus, what is needed is a system and method that would make it possible to utilize the extreme temperatures that are available in individual, deeply drilled wells for purposes of power generation.

Heretofore, as is well known in the power generating arts, there has been a need for an invention to address and solve the above-described problems. Accordingly, it should now be recognized, as was recognized by the present inventor, that there exists, and has existed for some time, a very real need for a system and method that would provide small scale power generation from a single or very small number of individual wells.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of the invention within the ambit of the pending claims.

SUMMARY OF THE INVENTION

There is provided herein a system and method for generating downhole electricity from wells or similar apertures that penetrate sufficiently deep into the subsurface. In the preferred embodiment, an abandoned oil or other well will be used and, most preferably, a well that reaches to a point in the subsurface where the ambient temperature at depth is significantly above the boiling point of water (i.e., greater than 212° F.). In some preferred embodiments, a depth of 10,000-20,000 feet should be sufficient, although the borehole might be shallower or deeper, depending on the local geothermal gradient.

A first preferred component of the instant invention is a downhole turbine, which contains blades that rotate transversely to the longitudinal axis of the turbine when presented with steam under pressure and especially when that steam originates below the turbine and/or proximate to the bottom of the borehole.

A second preferred component of the instant invention is a generator that is mechanically linked to the rotating turbine. In some preferred embodiments, the generator will take the form of a conventional downhole motor that has been reversed in the sense that, instead of electricity being used to turn it, the rotating force from the turbine will turn the generator/motor arm or armature and, as a consequence, produce an electrical current.

Another preferred component of the instant invention is a water delivery and, preferably, recovery system. In a preferred arrangement, water will be delivered into the well from the surface and down through a hollow pipe that lies at the center of the generator and, preferably, serves as its armature. Preferably, the water will then be conducted further downward through a hollow central shaft of the turbine which, in some preferred embodiments, will also serve as a mounting structure for the turbine blades. After passing through the turbine, the water will preferably be released, thereby allowing it to fall toward the bottom of the hole until it encounters temperatures sufficient to vaporize it. Further, in some preferred embodiments, the rising steam that turns the turbine blades will be collected as it condenses on the side of the borehole and rerouted downward through the generator/turbine combination and toward the bottom of the hole where it will be once again vaporized and rise toward the surface.

In view of the fact that many wells encounter rock that contains some amount of sulfur (e.g., via production of $H_2S$) or other corrosive materials therein, in some preferred embodiments the blades of the turbine will be made of (or coated with) a ceramic or some other anticorrosive material. In some embodiments, if the rock in which the well is drilled is soft or otherwise produces sand/contaminants in addition to the sulfur, the well bore could be lined with a steel, or if needed, non-corroding stainless steel casing so that the water/steam cycle within the well is maintained in a pure state and, such a case, more conventional turbine materials could be used.

In some preferred embodiments, packing or other material will be placed around the exterior of the turbine device to create at least a partial seal between the turbine and the interior of the well so that steam will be forced to move upward through the turbine's interior, thereby providing a force to turn the blades. Finally, electricity that is produced by the motor will be conducted to the surface via an electrical line where it can then be distributed onward for consumption.

The foregoing has outlined in broad terms the more important features of the invention disclosed herein so that the detailed description that follows may be more clearly understood, and on that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

BRIEF DESCRIPTION OF THE DRAWINGS

Other objects and advantages of the invention will become apparent upon reading the following detailed description and upon reference to the drawings in which.

DETAILED DESCRIPTION OF THE PREFERRED EMBODIMENTS

Figure 1:
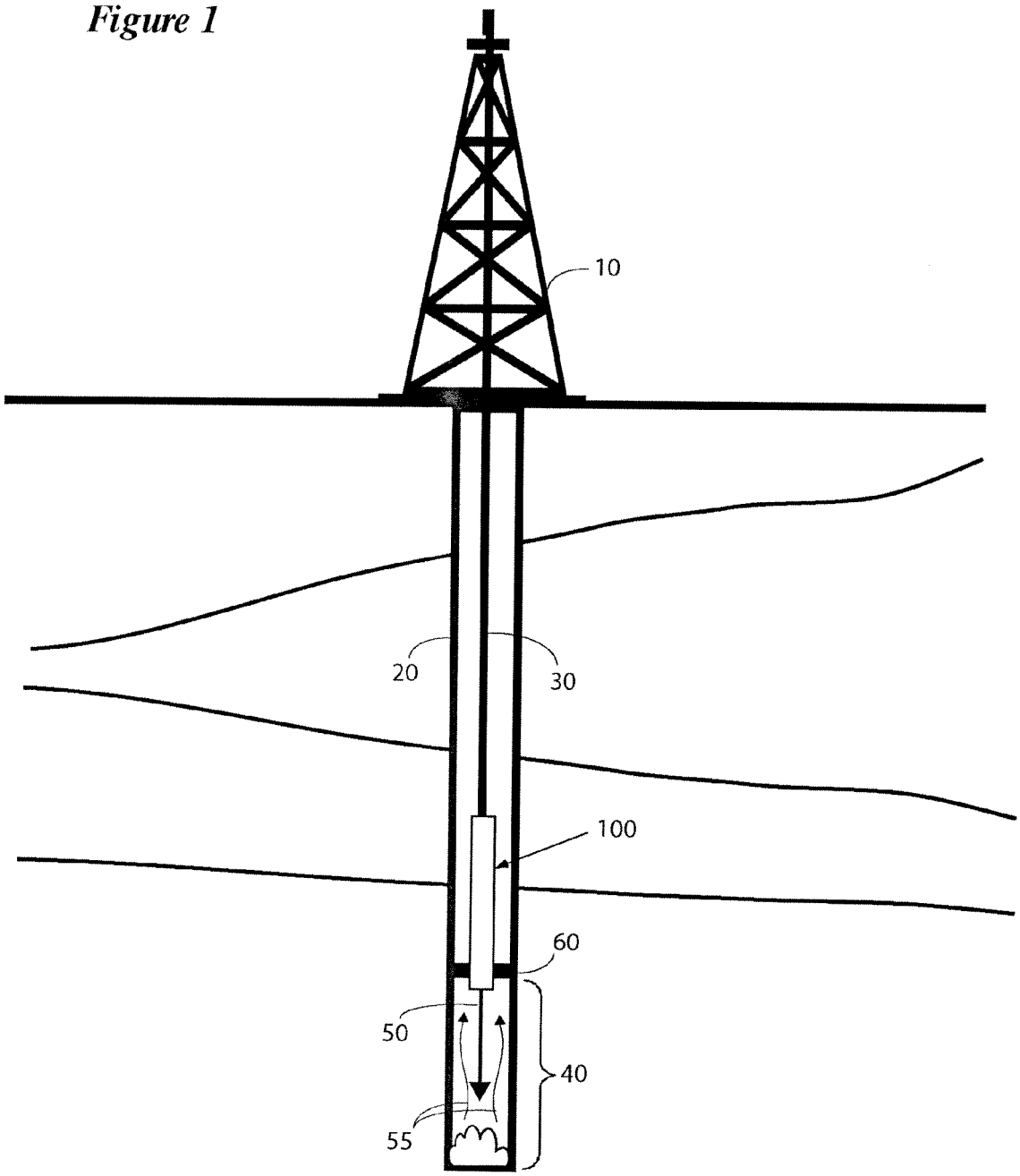
FIG. 1 contains a representation of the general environment of a preferred variation of the instant invention.

Referring now to the drawings, wherein like reference numerals indicate the same parts throughout the several views, there is provided a preferred system and method for generating electric power using geothermal energy.

Figure 2:
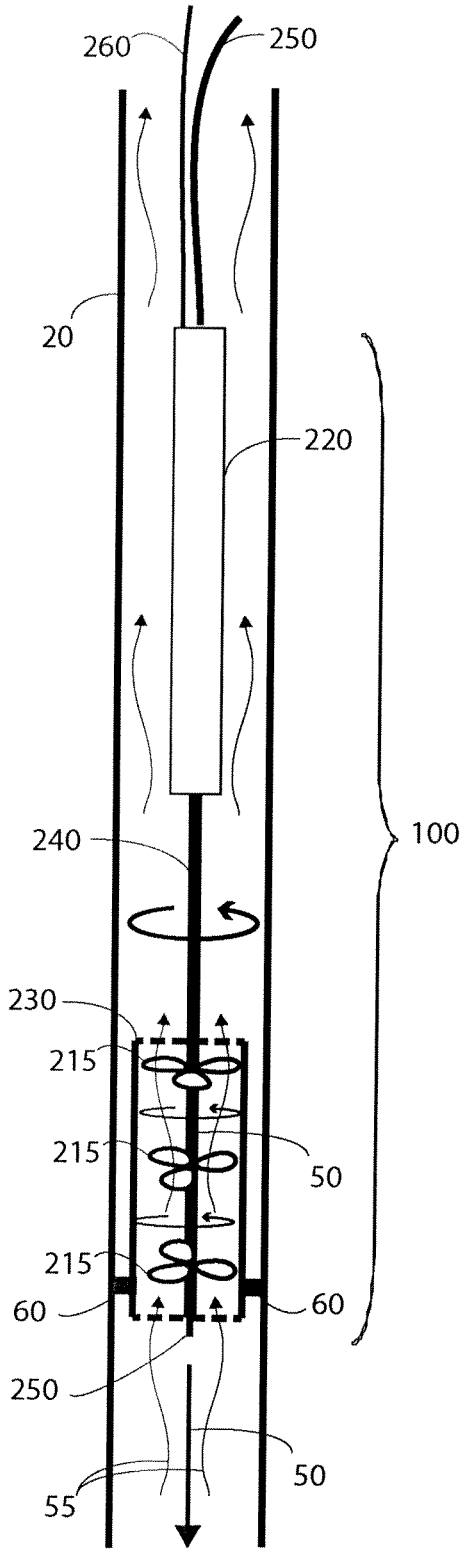
FIG. 2 contains a detailed view of the embodiment of FIG. 1.

As is generally indicated in FIG. 1, the instant invention 100 will preferably be positioned within a well bore 20 at some distance beneath the surface. The instant invention 100 will preferably be suspended or mounted within the well according to techniques well known to those of ordinary skill in the art. In addition to a wire cable or other means for lowering the instant invention into position and, preferably, maintaining it at a location above the bottom of the wellbore, there will additionally be, in a preferred embodiment, a water line that extends from the surface down to the instant invention 100 and at least one electrical line that travels from the instant invention 100 back up to the surface to convey electricity generated thereby. Conduit 30 in FIG. 1 is intended to generally represent all of the aforementioned items. FIG. 2, discussed below, contains additional details of this aspect of the instant invention.

Also as is generally indicated in FIG. 1, in the preferred arrangement water 50 will be supplied from the surface and/or accumulated from steam that is condensed along the wellbore 20 upper regions. Label 40 indicates in a general way the water 50/steam 55 cycle that powers the instant invention 100. That is, preferably and in brief, the instant invention 100 generates electricity by delivering water 50 to a heated well bore 20 and then using the resulting (preferably superheated) steam 55 that results to power an elongated turbine 230 as is discussed below.

In some preferred embodiments, and as generally indicated in FIG. 1, it is contemplated that some sort of packing 60, baffle or similar sealing structure will be in place around some portion of the instant invention so that rising steam 55 is forced to travel through the interior of the instant invention as is discussed in greater detail below.

FIG. 2 contains a more detailed view of the components of the instant invention 100. As a first preferred component, the lower member 230 will preferably be a turbine that contains some number of rotatable fan blades 215 therein, where "rotatable" is used in the sense that they are configured to impart a rotational force to the turbine when pressurized steam passes thereby. Generally speaking, the fan blades 215 will be horizontally rotatable, e.g., when the turbine is hung vertically within a well. Of course, if the instant invention has a non-vertical orientation (e.g., when directional drilling has been utilized), the rotational direction will be generally transverse to the longitudinal axis of the turbine.

Additionally, blocking the progress of steam as it emerges from further down hole will preferably be a peripheral mounted collar 60 that is designed to seal the case 230 of the turbine against the wall of the well bore 20 in which the instant turbine is situated.

In a preferred arrangement, a water conduit 250 will be in fluid communication with a corresponding hollow shaft that runs along the centerline of the generator 220. Preferably, the centerline shaft will also function as an armature (not shown) of the generator 200, although in some preferred arrangements a separate water line might run within the armature or external to the generator 220 as is discussed below. Additionally, in the event that water is routed through the interior of the generator 220 armature, a connecting shaft 240 will preferably further convey the water o, and preferably through, the central shaft of the turbine 230 so that it can be released via the water line terminus 250, to include any downward extension thereof, and through the center of the shaft 240 that interconnects the turbine 230 with the generator 220. Preferably, and as has been briefly discussed previously, water from the surface and/or water that has collected via condensation on the walls of the hole 20, will be brought to the generator and subsequently travel through a hollow shaft 240 which is rotatable in concert with the turbine blades 215. Of course, those of ordinary skill in the art will understand that the shaft 240 itself does not necessarily need to rotate: the turbine 230 and/or generator 220 could instead be bearing-mounted in such a way as to allow it to rotate about a stationary shaft 240.

This approach could potentially simplify the problems associated with getting liquid water past the instant invention 100 and to a depth where it will be converted to steam. Additionally, it is preferred that the water exit through the lower end of the turbine 230 through an opening in its radial center as is indicated in FIG. 2. That being said, those of ordinary skill in the art will understand that this is only a preferred arrangement and the waterline 250 might travel outside the generator (i.e., between the generator 220 and the wall of the hole 20). Additionally, the waterline 250 could be external to the turbine and be designed to penetrate through the collar 60 rather than travelling along the center of the generator 220/turbine 230 combination. However, given that the diameter of the wellbore 20 is likely to be on the order of 8 inches, the preferred arrangement would be for the water line 250 to travel along the axial center of these components and emerge at the bottom of the turbine as is indicated in FIG. 2.

The generator 220 could be an electric generator created specifically for this purpose or a downhole motor that has been repurposed as discussed below. A primary constraint is that it must fit within a well bore and, thus, would have to be long relative to its diameter. Given that many wellbores are 8 inches or so in diameter, it is anticipated that in some preferred embodiment's generator 220 would be sized to pass easily within a hole of this diameter.

Of course, those of ordinary skill in the art will recognize that an electric generator can readily be formed from an electric motor if the motor is reversed in sense, i.e., if a rotating force is applied to the drive shaft of the motor (rather than using electrical power to rotate the shaft) this will generate an electrical current. Given this broad view of what might constitute a generator suitable for use with the instant invention, there are any number of downhole motors that could serve in this capacity. As a specific example, electrical motors that are used for "turbo-drilling" (or turbine drilling) would be particularly well suited. Those of ordinary skill in the art will recognize that turbine drilling employs a downhole electrical motor that is situated directly above a drill bit. Then, rotation of the drill bit is accomplished by use of this downhole motor rather than rotation of the drill string above it. It should be noted that, among many others, Baker Hughes® has a technology it refers to as "Turbo Power™ Turbo Drills" that utilizes such a downhole motor that would be suitable for use with the instant invention. That being said, in some preferred embodiments a custom generator would be built according to methods well known to those of ordinary skill in the generator and/or motor arts.

In practice, in a typical configuration, the instant invention 100 would be lowered some distance within a well and secured with a collar 60 or other mechanism for sealing the bottom hole against the steam that will eventually be generated. The actual depth at which the instant invention 100 will be positioned will depend on the geological and/or geothermal factors in a particular well and the designer of the instant invention will have to trade off the advantage of having a smaller vaporization chamber (i.e., 40 in FIG. 1), versus the additional heat that would come to bear on the turbine 230/generator 220 combination if it were placed very deeply into the hole. Preferably, an abandoned well (or a well drilled specifically for purposes of the instant invention) that reaches a depth 10,000 feet or more will be utilized, as temperatures of the bottom of that well will likely be in the range of 350° or more. Obviously, the actual bottom hole temperature will depend heavily on the geothermal gradient in that area.

It is estimated that, assuming that the downhole temperature is in excess of 300°, liquid water delivered into that environment will produce about 80 lbs. per square inch of steam. The upward rushing steam 55 will encounter the turbine 230 and be directed to pass through it, thereby providing a force to turn the blades 215 of the turbine 230 which will be in mechanical communication with the drive shaft 240 which, thus, also turns in the present embodiment. The driveshaft 240 will then turn the driveshaft of the motor 220 which, in turn, will produce an electric current according to methods well-known to those of ordinary skill in the art. Of course, in some embodiments the turbine 230 and motor 220 might be in direct mechanical communication so that the turbine 230 directly turns the drive shaft of the motor 220.

In view of the fact that the downhole environment can be quite corrosive, some preferred embodiments will utilize ceramic (or ceramic coated metal) turbine blades 215 rather than bare metal ones. Of course, those of ordinary skill in the art will be familiar with situations in which corrosive environments might be encountered down hole and the proper turbine blade materials that might be used to accommodate such.

According to some preferred embodiments, the turbine 230 might be a few hundreds of feet in length (e.g., say, 200 feet) and utilize tens, hundreds, or even thousands of turbine blades 215 depending on the pressures and/or depths involved. Practically speaking, the diameter of the instant turban device 230—and, thus, the diameter of the associated fan blades 215—will be limited by the diameter of the well in which it is installed. As a consequence, many fan blades 215 may be necessary in order to get the rotational force necessary to turn the generator 220, although the diameter of the device 100 will be limited by the size of the hole, the turbine 230 can be arbitrarily long as the situation warrants.

Although the exact amount of electricity that might be generated by instant device 100 depends on any number of the factors that have been discussed above (e.g., the type of motor, the number and dimensions of the turbine blades, the heat of the subsurface, the volume of water that's moved into the heated zone, the steam pressure, etc.), it is estimated that in some cases as the instant invention might be able, in some embodiments, to generate in excess of 1 Mw of electricity. For example, there are known electric motors that are about 7.9 inches in diameter and draw about 1.4 Mw of power. That would imply that a 1.4 Mw generator should be within the realm of possibility. One limiting factor would be the availability of a steady supply of high-pressure steam to rotate the turbine, but if such is not available at a shallow depth drilling deeper would generally be an option.

Although FIG. 1 indicates that the instant invention might be used in connection with an oil derrick, in reality, in many cases the instant device would be lowered into the subsurface using a wireline or logging truck or something similar.

Note that in some variations of the instant invention, rather than utilizing an existing/abandoned oil or other well, a well might be drilled specifically for purposes of generating electricity. An investment in drilling such a well could make good economic sense. For example, the cost of drilling a well to about 10,000 feet would cost, depending on the type of rock, in the neighborhood of $500,000-$750,000. Assuming that the costs of drilling down an additional 10,000 feet (i.e., 20,000 feet total) would be at least double the cost of total cost (assuming it was necessary to reach such a depth). If the well produces 1 Mw of electricity through use of the instant invention, this means that the electricity produced thereby would cost about $1.00 per watt over the operating life of the instant invention. Further, one thousand wells distributed over an area of, say, a couple of square miles will cost about a billion dollars but would yield twice the electric generating capacity of a nuclear reactor without the concomitant environmental risks.

Figure 3:
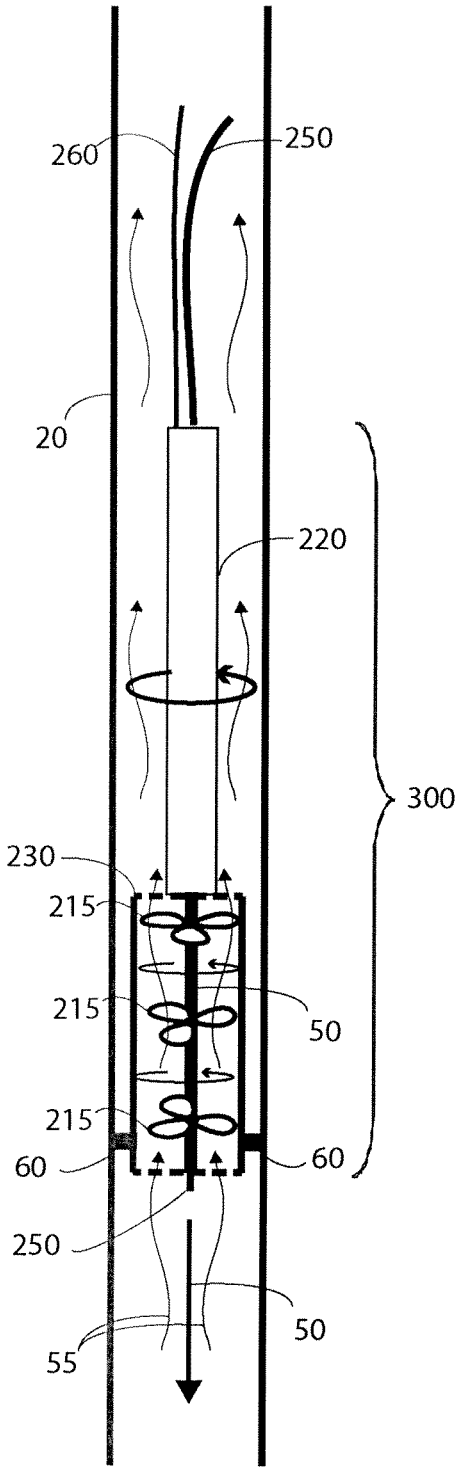
FIG. 3 contains a detailed view of another embodiment of the instant invention, wherein the turbine and generator are integrated into a single enclosure.

Note further that in some embodiments, the generator and turbine might be integrated into a single unit in a manner similar to that illustrated in FIG. 3. Further, the blades on the turbine 230 might be on its exterior (or the turbine 230 might merely be an enclosed shaft with blades 215 attached thereto). These and other variations of the instant invention are well within the ability of one of ordinary skill in the art to design.

In still other embodiments, a motor that is suitable for driving a downhole submersible pump might be utilized as a generator. As an example only, it is known that such motors are available that can operate at temperatures of up to 300° F. (149° C.) and high pressures of up to 5,000 psi (34 MPa), from deep wells of up to 12,000 feet (3.7 km) deep with energy requirements of up to about 1000 horsepower (750 kW). This means that such motors would be expected to produce up to about 750 kW of electricity when used as a generator according to the instant invention.

Although the term "water" has been used throughout the instant application, that was not done out of any intent to limit the particular application to uses only with $H_2O$. Indeed, the instant inventor has conceived of embodiments to the instant invention that utilize other liquids such as alcohol, ether, etc., or any other liquid that has a suitable vaporization/condensation cycle. Thus, in the claims that follow, when the term "water" is used, that term should broadly be construed to be any liquid that satisfies the suitability criteria mentioned supra.

Finally, and as still another specific example of a motor that would be suitable for use with the instant invention, there is downhole Baker-Hughes Centralift™ motor that has a long run life (5 to ten years or more) and would produce about 1125 kW of power when used according to the instant invention.

Thus, the present invention is well adapted to carry out the objectives and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made by those of ordinary skill in the art, without departing from the spirit of the invented concept, the scope of which is to be determined by the following claims.

What is claimed is:

1. A downhole electric generating system for producing electricity from within a well bore having a lower terminus at a temperature at least sufficient to produce steam from liquid water, comprising:

a. a generator sized to be smaller than a diameter of the well bore, said generator having a rotatable component for generating an electrical current when so rotated;

b. a turbine sized to be smaller than the diameter of the well bore, said turbine containing a plurality of rotatable blades, said rotatable blades delivering a rotational force in the presence of steam originating from below said turbine in the well bore, said rotatable blades being in fluid communication with the well bore; and, c. a water delivery system, said water delivery system at least for delivering liquid water to a depth in the well bore below said turbine, said liquid water at least for being converted to steam to power said turbine; and d. a drive shaft in mechanical communication with said generator and with said turbine, said drive shaft delivers rotational force from said turbine to said generator and serves as a conduit for said water delivery system.

2. The downhole electrical generating system according to claim 1, wherein said downhole generator is a downhole electric motor.

3. The downhole electrical generating system according to claim 1, wherein said downhole generator and said turbine are integrated into a single unit.

4. The downhole electrical generating system according to claim 1, wherein said rotatable blades have a ceramic coating.

5. The downhole electrical generating system according to claim 1, further comprising:

e. at least one electrical line between said generator and the surface, said at least one electrical line being at least for transmitting an electrical current from said generator to the surface.

6. A downhole electric generating system for producing electricity from within a well bore having a lower terminus at a temperature in excess of a boiling point of water, comprising:

a. an electrical generator sized to be smaller than a diameter of the well bore, said generator having a rotatable component for generating an electrical current when so rotated; and, b. a turbine sized to be smaller than the diameter of the well bore, said turbine containing a plurality turbine blades in fluid communication with the well bore that are rotatable about a longitudinal axis of said turbine, said rotatable blades are urged into rotation by steam under pressure that originates external to said downhole electric generating system and that is produced from within the well bore via a water delivery system; and, c. a drive shaft in mechanical communication with said generator and with said turbine, said drive shaft delivers rotational force from said turbine to said generator and serves as a conduit for said water delivery system.

7. The downhole electrical generating system according to claim 6, wherein said downhole generator is an electric motor.

8. The downhole electrical generating system according to claim 6, wherein said downhole generator and said turbine are integrated into a single downhole unit.

9. The downhole electrical generating system according to claim 6, wherein said rotatable blades have a ceramic coating.

10. The downhole electrical generating system according to claim 6, further comprising:

d. a water delivery system, said water delivery system at least for delivering liquid water to a depth in the well bore below said turbine, said liquid water at least for being converted to steam to power said turbine.

11. A downhole electric generating system for producing electricity from within a well bore having a lower terminus at a temperature at least sufficient to produce steam from liquid water, comprising:

a. a generator sized to be smaller than a diameter of the well bore, said generator having a rotatable component for generating an electrical current when so rotated;

b. a turbine sized to be smaller than the diameter of the well bore, said turbine containing a plurality of rotatable blades, said rotatable blades delivering a rotational force in the presence of steam originating from below said turbine in the well bore, wherein said rotatable blades are in fluid communication with the well bore; and, c. a water delivery system, said water delivery system at least for delivering liquid water from a location proximate to the surface to a depth in the well bore below said turbine, said liquid water at least for being converted in said borehole to steam to power said turbine; and, d. a drive shaft in mechanical communication with said generator and with said turbine, said drive shaft delivers rotational force from said turbine to said generator and serves as a conduit for said water delivery system.

12. The downhole electrical generating system according to claim 11, wherein said downhole generator is an electric motor.

13. The downhole electrical generating system according to claim 11, wherein said downhole generator and said turbine are integrated into a single downhole unit.

14. The downhole electrical generating system according to claim 11, wherein said rotatable blades have a ceramic coating.

15. A method of generating electricity, comprising the steps of:

a. positioning an electrical generator within a bore hole;

b. positioning a turbine within the borehole in fluid communication with said bore hole; and c. delivering liquid water within the bore hole to a depth sufficient to produce steam, wherein the steam is produced at a pressure sufficient to urge at least a portion of said turbine to rotate; and, d. providing a drive shaft in mechanical communication with said generator and with said turbine, said drive shaft delivers rotational force from said turbine to said generator and serves as a conduit for said water delivery system.

* * * * *